US005836788A

United States Patent [19]

Torii

[11] Patent Number: 5,836,788

[45] Date of Patent: Nov. 17, 1998

[54] WATERPROOF PRESS-CONNECTING CONNECTOR

[75] Inventor: Chieko Torii, Shizuoka, Japan

[73] Assignee: Yazaki Corporation, Tokyo, Japan

[21] Appl. No.: 698,146

[22] Filed: Aug. 15, 1996

[30] Foreign Application Priority Data

Sep. 5, 1995 [JP] Japan ..... 7-228167

[51] Int. Cl.[6] ..... H01R 13/40

[52] U.S. Cl. ..... 439/587; 439/275

[58] Field of Search ..... 439/587, 598, 439/274, 275, 279, 523, 456, 459

[56] References Cited

U.S. PATENT DOCUMENTS 4,690,478 9/1987 Rahrig et al. ..... 439/271

FOREIGN PATENT DOCUMENTS 4-49480 4/1992 Japan .

*Primary Examiner*—Neil Abrams
*Assistant Examiner*—T. C. Patel
*Attorney, Agent, or Firm*—Morgan, Lewis & Bockius LLP

[57] ABSTRACT

A waterproof press-connecting connector of the invention includes a terminal holder for holding a plurality of press-connecting terminals in a juxtaposed manner, a mat seal of a soft, elastic material having a plurality of juxtaposed wire seal holes formed therethrough, and a housing having an opening having a peripheral edge portion in which an outer peripheral surface of the mat seal is fitted watertight. A cover plate for pressing the mat seal is formed integrally at a rear end of the terminal holder. A projected plate is formed on one inner surface of the peripheral edge portion of the opening in the housing, and a support projection is formed on the peripheral edge portion in opposed relation to the projected plate. A projected portion, through which the wire seal holes extend, is formed integrally on the front surface of the mat seal, and is disposed on a front end of a proximal portion of the terminal holder. The projected plate, having a slanting surface formed at its distal end, is formed on the one inner surface of the housing at the inner periphery thereof.

6 Claims, 5 Drawing Sheets

WATERPROOF PRESS-CONNECTING CONNECTOR

BACKGROUND OF THE INVENTION

1. Field of the Invention

This invention relates to a waterproof press-connecting connector having a sealing effect, and more particularly to a waterproof press-connecting connector having a strain relief structure provided in a connector housing for preventing rearward withdrawal of wires.

2. Background

There are already known various kinds of waterproof press-connecting connectors in which a sealing effect of the press-connecting connector, having press-connecting terminals received therein, is secured by a mat seal made of a soft, elastic material. Reference is now made, for example, to a waterproof press-connecting connector disclosed in Examined Japanese Utility Model Publication No. 4-49480. FIG. 4 is an exploded, perspective view of the conventional waterproof press-connecting connector. FIG. 5 is a perspective view showing a process of assembling the connector of FIG. 4.

As shown in FIG. 4, the waterproof press-connecting connector 51 includes a terminal holder 53 having a plurality of press-connecting terminals 52 mounted thereon in a juxtaposed manner, a connector cover 54 for covering a plurality of sheathed wires 4 to which the terminal holder 53 is press-connected, a sheet-like mat seal 55 (which is made of soft, elastic material such as rubber) having a plurality of juxtaposed wire seal holes 56 (through which the wires 4 are sealingly passed, respectively) formed therethrough, and a housing 57 for housing a press-connecting portion of the terminal holder 53 in watertight manner.

More specifically, a pair of retaining piece portions 58 are formed respectively at opposite ends of the connector cover 54, and are adapted to be retainingly engaged respectively with corresponding retaining pawls 59 formed respectively at opposite ends of the terminal holder 53. An outer peripheral surface 61 of the mat seal 55 is adapted to fit watertight in a peripheral edge portion 60 of an opening in the housing 57.

In the above construction, first, the plurality of wires 4 are passed respectively through the wire seal holes 56 in the mat seal 55, and the wires 4 are so adjusted that they project forwardly the same distance L from the mat seal 55, and then the wires 4 are press-connected to the respective press-connecting terminals 52. The connector cover 54 is attached to the terminal holder 53 to cover the same, with the retaining piece portions 58 retainingly engaged with the respective retaining pawls 59, thus assembling the press-connecting connector 62.

Then, as shown in FIG. 5, the housing 57 is fitted on this connector from the front side thereof, thus completing the assembly of the waterproof press-connecting connector. At this time, the outer peripheral surface 61 of the mat seal 55 is fitted watertight in the peripheral edge portion 60 of the opening in the housing 57, and also the wire seal holes 56 tighten the wires 4, respectively, so that the press-connecting connector 62 is held watertight in the housing 57.

However, the above conventional waterproof press-connecting terminal 51 has a problem that when the wire 4 is pulled hard rearwardly, the retaining force, provided by the press-connecting terminal 52, is not sufficient, so that the wire 4 is withdrawn rearwardly.

After the plurality of wires 4 are press-connected to the respective press-connecting terminals 52, the connector cover 54 is fitted on the terminal holder 53, and further the housing 57 is fitted thereon in a watertight manner. Therefore, there is another problem that the assembling process is complicated.

SUMMARY OF THE INVENTION

With the above problems in view, it is an object of this invention to provide a waterproof press-connecting connector in which the press-connecting connector, to which wires are press-connected, is kept watertight, and there is provided a strain relief function for ensuring a sufficient holding force even if a strong pulling force is applied to the wires, and the assembly of the waterproof press-connecting connector can be effected easily.

The above object of the invention has been achieved by a waterproof press-connecting connector wherein a mat seal of a soft, elastic material, having a plurality of juxtaposed wire seal holes formed therethrough, is fitted on a terminal holder having press-connecting terminals mounted thereon in a juxtaposed manner, and then a plurality of sheathed wires are passed respectively through the wire seal holes, and then are press-connected to the press-connecting terminals, respectively, and then the terminal holder is inserted into a housing, so that an outer peripheral surface of the mat seal is fitted watertight in a peripheral edge portion of an opening in the housing. A cover plate for pressing the mat seal is formed at a rear end of the terminal holder; a projected portion, through which the wire seal holes extend, is formed integrally on a front surface of the mat seal; and a projection is formed on one inner surface of the peripheral edge portion of the opening in the housing, the projection having a slanting surface at its distal end.

A support projection for supporting the terminal holder is provided in opposed relation to the projection.

In the waterproof press-connecting connector of the above construction, when the housing is fitted on the terminal holder, and is retained relative thereto, the mat seal is held by the cover plate, the projection and the support projection, so that the outer peripheral surface of the mat seal is held in firm contact with the peripheral edge portion of the opening in the housing, and also the wire seal holes tighten the respective wires hard, and therefore the terminal holder, including the press-connected wires, is protected in a watertight manner.

Since the slanting surface of the projection presses the projected portion of the mat seal forwardly downwardly, the wires in the respective wire seal holes are pressed hard forwardly downwardly, and therefore even if there is applied a strong pulling force tending to pull the wires rearwardly, a sufficient resistance to this pulling force is provided. Namely, a strain relief function is achieved.

Since the cover plate is formed at the rear end of the terminal holder, it is not necessary to cover the terminal holder with a connector cover as in the conventional construction, and therefore the housing can be fitted directly on the terminal holder. Therefore, the connector-assembling process can be simplified.

The above object has also been achieved by a construction in which a step portion is formed at a proximal portion of the terminal holder disposed adjacent to a front surface of the cover plate.

In the above construction, the projected portion of the mat seal is pressed to be bent forwardly downwardly by the step portion and the slanting surface, and therefore the wires in the respective wire seal holes are pressed harder forwardly downwardly. Therefore, even if a strong pulling force tending to pull the wires rearwardly is applied, the more sufficient holding force is secured.

DETAILED DESCRIPTION OF THE PREFERRED EMBODIMENT

Figure 1:
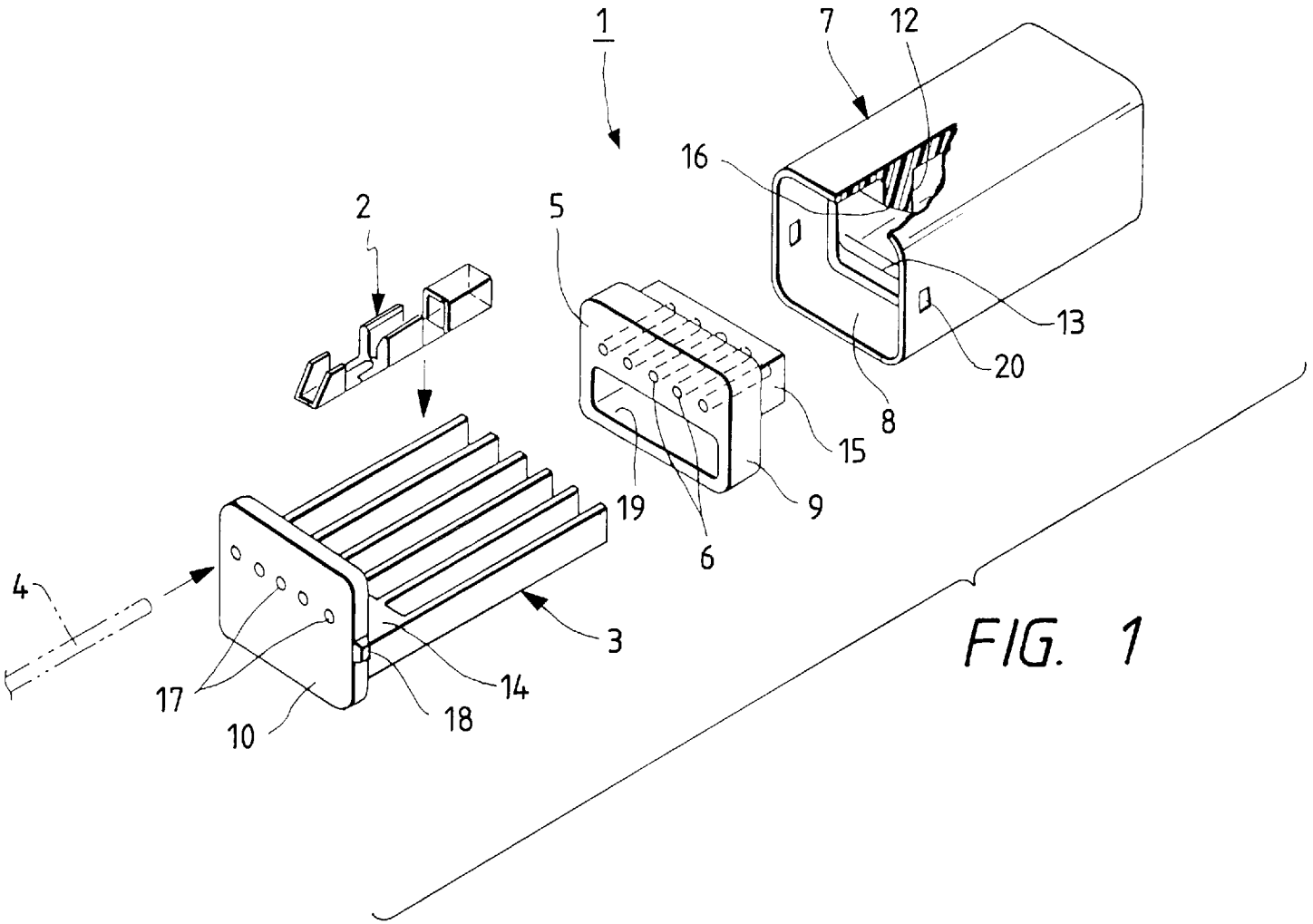
FIG. 1 is an exploded, perspective view of one preferred embodiment of a waterproof press-connecting connector of the invention.
Figure 2:
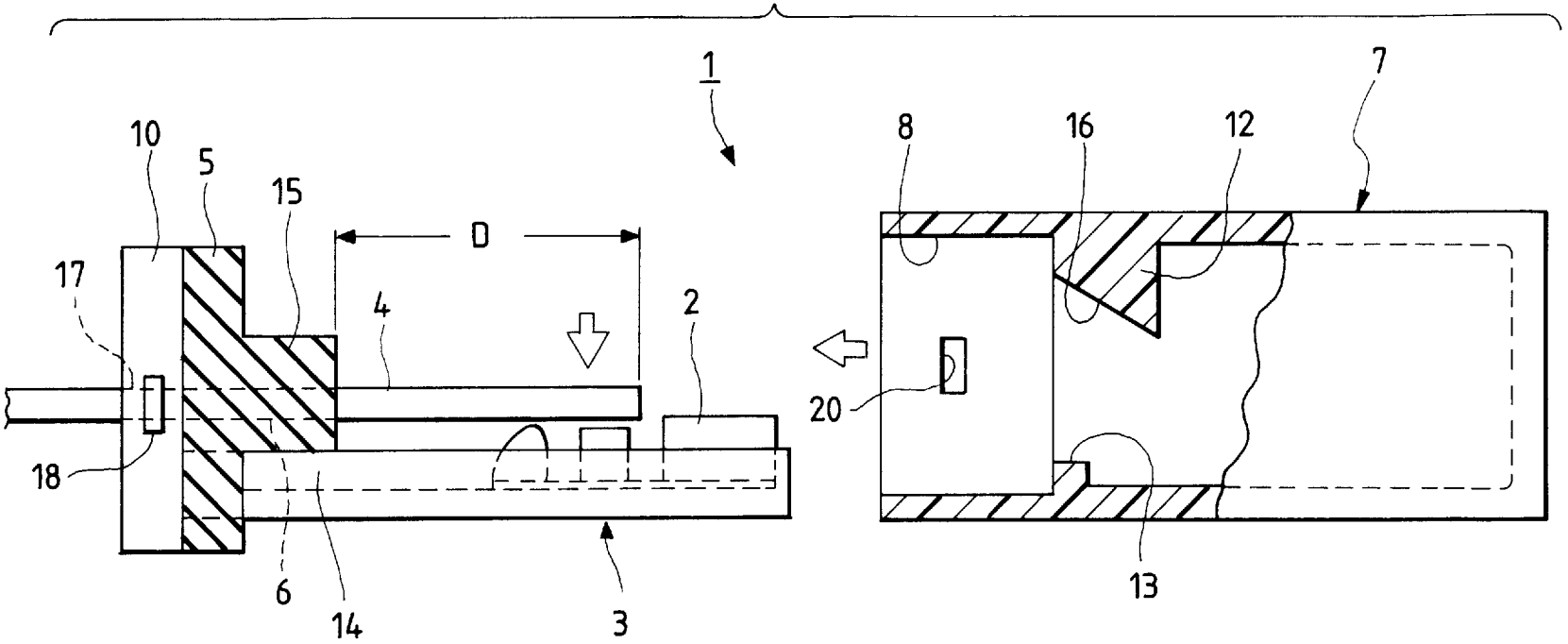
FIG. 2 is a cross-sectional view showing a process of assembling the connector of FIG. 1.
Figure 3:
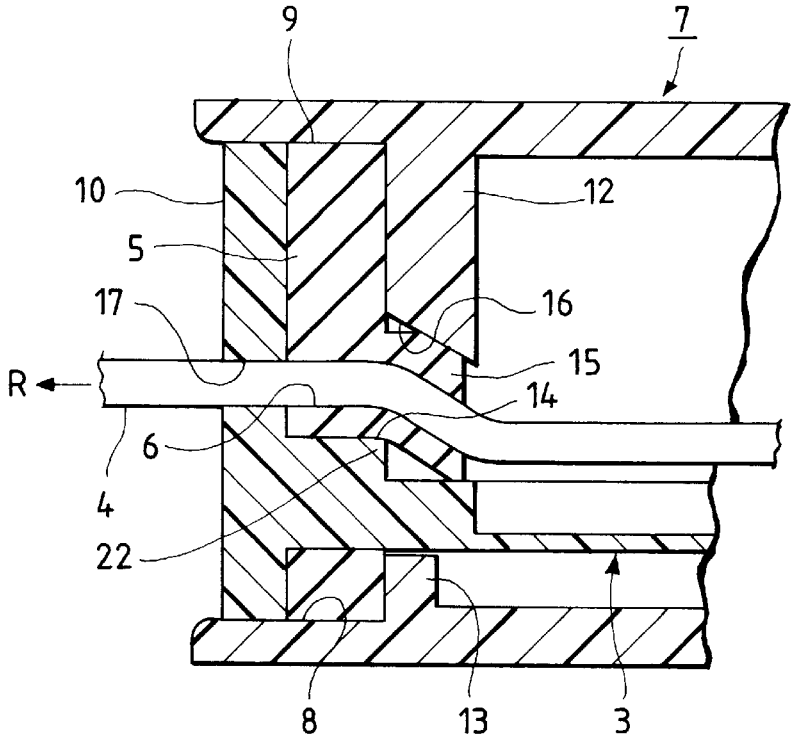
FIG. 3 is a cross-sectional view of an important portion of the connector of FIG. 1 in its completely-assembled condition.

A preferred embodiment of the present invention will now be described with reference to FIGS. 1 to 3. FIG. 1 is an exploded, perspective view of one preferred embodiment of a waterproof press-connecting connector of the invention, FIG. 2 is a cross-sectional view showing a process of assembling the connector of FIG. 1, and FIG. 3 is a cross-sectional view of an important portion of the connector of FIG. 1 in its completely-assembled condition.

As shown in FIG. 1, the waterproof press-connecting connector 1 of this embodiment includes a terminal holder 3 for holding a plurality of press-connecting terminals 2 (to which sheathed wires 4 are press-connected, respectively) in a juxtaposed manner, a mat seal 5 (which is made of a soft, elastic material such as rubber) having a plurality of juxtaposed wire seal holes 6 formed therethrough, and a housing 7 which receives the terminal holder 3 therein, and has an outer peripheral surface 9 of the mat seal 5 fitted watertight in a peripheral edge portion 8 of an opening thereof.

A cover plate 10 for pressing the mat seal 5 is formed integrally at a rear end of the terminal holder 3. A projected plate 12 is formed on one inner surface of the peripheral edge portion 8 of the opening in the housing 7, and a support; projection 13 is formed on the peripheral edge portion 8 in opposed relation to the projected plate 12.

A projected portion 15, through which the wire seal holes 6 extend, is formed integrally on the front surface of the mat seal 5, and is disposed on a front end of a proximal portion 14 of the terminal holder 3.

The projected plate 12, having a slanting surface 16 formed at its distal end, is formed on the one inner surface of the housing 7 at the inner periphery thereof. When the terminal holder 3 is inserted into the housing, the projected portion 15 is brought into engagement with the slanting surface 16, and is pressed forwardly downwardly.

More specifically, a plurality of insertion holes 17 (through which the wires 4 are extended rearwardly, respectively) are formed through the cover plate 10. A pair of retaining pawls 18 for being retainingly engaged with the housing 7 are formed on opposite ends of the cover plate 10, respectively. A through hole 19 is formed through the mat seal 5, and the terminal holder 3 is extended through this through hole 19 from the rear side of the mat seal 5. A pair of retaining holes 20 are formed respectively in opposite side walls of the housing 7, and the retaining pawls 18 are retainingly engaged in the retaining holes 20, respectively.

In the waterproof press-connecting connector 1 of the above construction, the front end of the terminal holder 3 is first inserted into the through hole 19 in the mat seal 5, and the terminal holder 3 is passed through the through hole 19 until the cover plate 19 is brought into contact with the mat seal 5. Then, the press-connecting terminals 2 are mounted in the terminal holder 3.

Then, as shown in FIG. 2, the wires 4 are passed from the rear side through the respective insertion holes 17 and the respective wire seal holes 6, and are adjusted in such a manner that these wires 4 project a distance D from the mat seal 5. Then, the wires 4 are press-connected respectively to the press-connecting terminals 2 from the upper side. Then, the terminal holder 3 is inserted into the housing 7 from the front side thereof, and is pushed until the retaining pawls 18 are retainingly engaged in the retaining holes 20, respectively, thus completing the assembly of the waterproof press-connecting connector 1. At this time, the mat seal 5 is held by the cover plate 10, the projected plate 12 and the support projection 13, and the projected portion 15 is pressed forwardly downwardly by the slanting surface 16, as shown in FIG. 3.

As described above, when the terminal holder 3 is loosely fitted into the housing 7, and is retained relative thereto, the mat seal 5 is held by the cover plate 10, the projected plate 12 and the support projection 13. Therefore, the outer peripheral surface 9 of the mat seal 5 is held in firm contact with the peripheral edge portion 8 of the opening in the housing 7, and the wire seal holes 6 tighten the respective wires 4 hard, as shown in FIG. 3, and therefore the terminal holder 3, having the press-connected wires 4, is held in a watertight manner.

The slanting surface 16 of the projected plate 12 presses the projected portion 15 of the mat seal 5 forwardly downwardly, and since a step portion 22 is formed at a rear portion of the proximal portion 14 of the terminal holder 3, the wires 4 are forcibly bent. With this arrangement, the wires 4 have a strain relief structure, and even if a pulling force, acting, for example, in the rearward direction, is applied to the wires 4, the wires will not be withdrawn rearwardly. Therefore, there can be provided the waterproof press-connecting connector having high reliability.

Since the cover plate 10 is formed at the rear end of the terminal holder 3, there is no need to fit the connector cover 54 on the terminal holder 3 as in the conventional construction, and the housing 7 can be fitted directly on the terminal holder. Therefore, the assembling process can be simplified, and the efficiency of the operation is enhanced.

Figure 6:
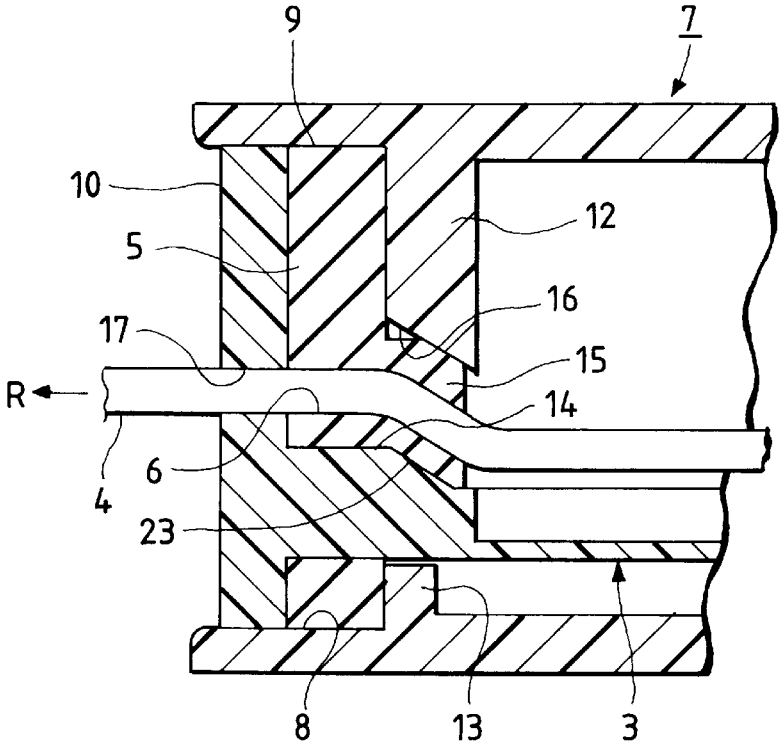
FIG. 6 is a cross-sectional view of another preferred embodiment of a waterproof press-connecting connector of the invention.
Figure 4:
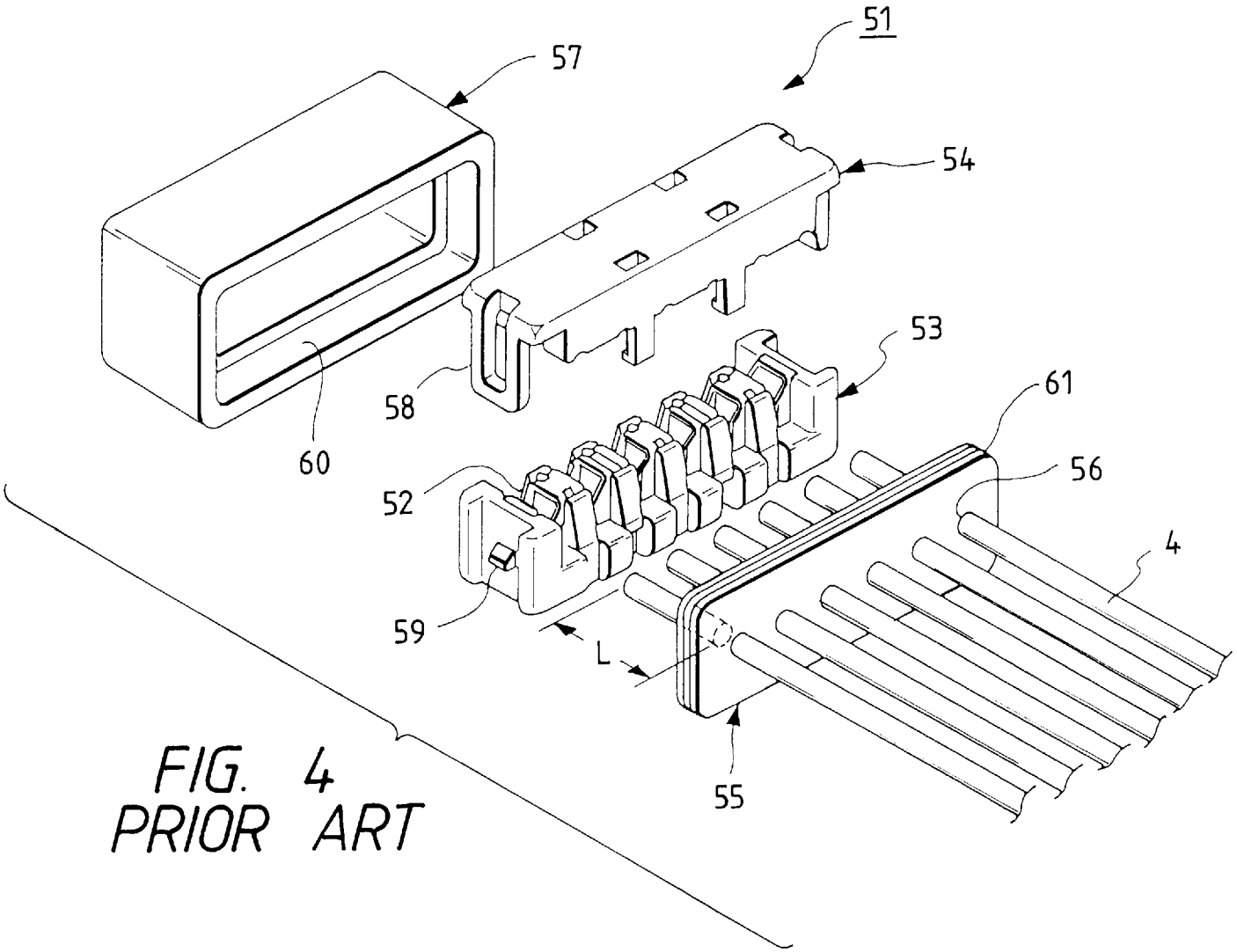
FIG. 4 PRIOR ART
FIG. 4 is an exploded, perspective view of a conventional waterproof press-connecting connector.
Figure 5:
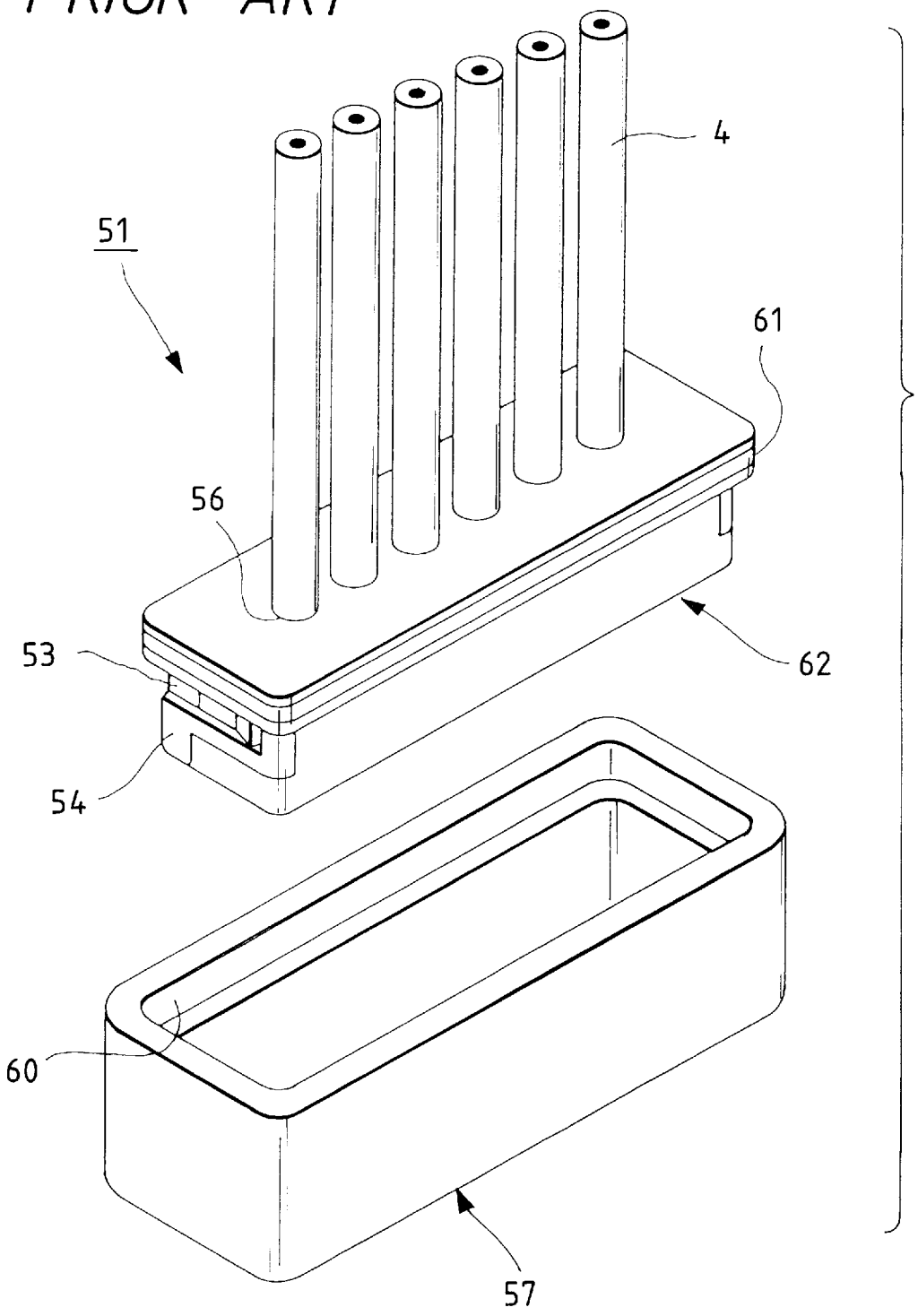
FIG. 5 PRIOR ART
FIG. 5 is a perspective view showing a process of assembling the connector of FIG. 4.

The present invention is not to be limited to the above embodiment, and other embodiments of the invention can be provided by making suitable modifications. For example, although the stair-like step portion 22 is provided in this embodiment as shown in FIG. 3, this step portion may be replaced by a forwardly downwardly-slanting surface 23 disposed in opposed relation to the slanting surface 16 of the projected plate 12 as shown in FIG. 6. Since this slanting surface 23 and the slanting surface 16 of the projected plate 12 cooperate with each other to hold the projected portion 15 of the mat seal 5 therebetween in a slanting manner, the stable strain relief function can be expected.

As described above, in the waterproof press-connecting connector, the cover plate for pressing the mat seal is formed at the rear end of the terminal holder, and the projected portion, through which the wire seal holes extend, is formed integrally on the front surface of the mat seal, and the projection is formed on one inner surface of the peripheral edge portion of the opening in the housing, the projection having the slanting surface at its distal end. The support projection for supporting the terminal holder is provided in opposed relation to the projection.

Therefore, when the terminal holder is inserted into the housing, and is retained relative thereto, the mat seal is held by the cover plate, the projection and the support projection, so that the outer peripheral surface of the mat seal is held in firm contact with the peripheral edge portion of the opening in the housing, and also the wire seal holes tighten the respective wires hard, and therefore the terminal holder, including the press-connected wires, is held in a watertight manner. Therefore, the sealing effect of the press-connecting connector is positively secured.

The slanting surface of the projection presses the projected portion of the mat seal forwardly downwardly, and the step portion is provided at the front end of the proximal portion of the terminal holder, and therefore the wires are forcibly bent.

Therefore, there is provided the strong holding force which prevents the rearward withdrawal of the wires even if a rearward pulling force is applied to the wires, and there can be provided the waterproof press-connecting connector having high reliability.

Since the cover plate is formed at the rear end of the terminal holder, the use of a connector cover is unnecessary, and this simplifies the assembling process, and therefore the efficiency of the operation is enhanced.

what is claimed is:

1. A connector, comprising:

a housing which includes an opening having a peripheral edge portion;

a projection formed on an inner surface of said housing said projection having a slanting surface formed at the distal end thereof, a mat seal made of an elastic material, having a plurality of wire holes and a through hole formed respectively therethrough, and having an outer peripheral surface and a projected portion through which said wire holes extend, said projected portion formed integrally on a front surface thereof;

a terminal holder extended through said through hole, said terminal holder including a cover plate formed at rear end thereof for pressing said mat seal to said housing;

said slanting surface abutting said projected on of said mat seal when said mat seal is pressed to said housing;

said terminal holder inserted into said housing so that said outer peripheral surface of said mat seal is fitted watertight in said peripheral edge portion of said opening in said housing;

a plurality of press-connecting terminals mounted on said terminal holder; and a plurality of wires passing respectively through said wire holes, said wires press-connected to said press-connecting terminals.

2. The connector of claim 1, wherein a support projection for supporting said terminal holder is formed in opposed relation to said projection.

3. The connector of claim 1, wherein a step portion is formed at a proximal portion of said terminal holder disposed adjacent to a front surface of said cover plate.

4. The connector of claim 3, wherein when said terminal holder is inserted into said housing, said slanting surface of said projection presses said projected portion of said mat seal forwardly and downwardly.

5. The connector of claim 1, wherein a slanting surface is formed at a proximal portion of said terminal holder disposed adjacent to a front surface of said cover plate so as to oppose to said slanting surface of said projection.

6. The connector of claim 1, wherein a plurality of insertion holes for passing said wires are formed through said cover plate.

* * * * *